US006761288B2

(12) United States Patent
Garcia

(10) Patent No.: US 6,761,288 B2
(45) Date of Patent: Jul. 13, 2004

(54) FLUID DISPENSER

(75) Inventor: Firmin Garcia, Evreux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/123,181

(22) Filed: Apr. 17, 2002

(65) Prior Publication Data

US 2002/0190081 A1 Dec. 19, 2002

Related U.S. Application Data

(60) Provisional application No. 60/303,793, filed on Jul. 10, 2001, and provisional application No. 60/304,075, filed on Jul. 11, 2001, now abandoned.

(30) Foreign Application Priority Data

Jun. 19, 2001 (FR) ..... 01 08037

(51) Int. Cl.[7] ..... B65D 37/00
(52) U.S. Cl. ..... 222/214; 222/107
(58) Field of Search ..... 222/103, 105, 222/107, 213, 214, 94, 95

(56) References Cited

U.S. PATENT DOCUMENTS 2,596,592 A * 5/1952 Parker ..... 222/92
3,215,319 A * 11/1965 Laker ..... 222/213
3,319,837 A * 5/1967 Mueller ..... 222/212
3,451,597 A * 6/1969 Watson, Jr. ..... 222/207
4,098,434 A * 7/1978 Uhlig ..... 222/94
5,222,822 A * 6/1993 Hernandez ..... 401/153
5,241,150 A * 8/1993 Garvey et al. ..... 219/725
5,261,571 A * 11/1993 Goncalves ..... 222/214
5,368,199 A * 11/1994 Haas et al. ..... 222/146.5
5,683,013 A * 11/1997 Morrison ..... 222/103

FOREIGN PATENT DOCUMENTS

| | | |
|---|---|---|
| FR | 2 791 645 A | 10/2000 |
| GB | 1 530 333 A | 10/1978 |
| WO | WO 96 01215 A | 1/1996 |
| WO | WO 99 59881 A | 11/1999 |

* cited by examiner

*Primary Examiner*—Gene Mancene
*Assistant Examiner*—Melvin A Cartagena
(74) *Attorney, Agent, or Firm*—Sughrue Mion, PLLC

(57) ABSTRACT

A fluid dispenser comprising a fluid reservoir (111) of variable volume, and a dispensing orifice (130), said reservoir being provided with at least one deformable actuating wall (112) urged by resilient means (15) into a rest position corresponding to the reservoir having its maximum volume, said dispenser being characterized in that the resilient means (15) are situated outside the reservoir (111), not in contact with the fluid.

24 Claims, 3 Drawing Sheets

1
110
111
112
152
13
14
130
16
151
150
15
11
12
116

FLUID DISPENSER

CROSS REFERENCE TO RELATED APPLICATION

This application claims the benefit under 35 U.S.C. §119 (e) of U.S. provisional patent application Serial No. 60/304,075, filed Jul. 11, 2001 now abandoned, and priority under 35 U.S.C. §119(a)–(d) of French patent application No. FR-01.08037, filed Jun. 19, 2001.

TECHNICAL FIELD

The present invention relates to a fluid dispenser comprising a fluid reservoir of variable volume, and a dispensing orifice. The reservoir is provided with at least one deformable actuating wall urged by resilient means, e.g. a return spring, into a rest position in which the reservoir reaches its maximum volume.

BACKGROUND OF THE INVENTION

A dispenser of this type is described, for example, in Document FR 2 791 645. The dispenser of that document is made up of two flexible sheets bonded together over their peripheries to define an internal volume which serves as a reservoir for the fluid. In addition, a piece is provided that is held between the two sheets and that closes off the reservoir. That piece is generally made of a plastics material and it defines a dispensing orifice through which the fluid can be dispensed from the reservoir in the form of a spray. In the initial storage state, prior to use, the dispensing orifice is closed off by a removable closure member that prevents the fluid from exiting from the reservoir, and also prevents air from penetrating into the reservoir through the dispensing orifice. An advantageous characteristic of that prior art document lies in the fact that the removable closure member closes off the dispenser when the reservoir contains no air or very little air. As a result, there is almost only fluid inside the reservoir. Since the quantity of fluid is small, the reservoir then presents a minimum volume so that the two flexible sheets making up the reservoir are almost touching. A return spring is disposed inside the reservoir to move the two sheets apart and thus to bring the reservoir into the rest position in which it defines a maximum working volume. When the removable closure member is in place, the return spring is fully compressed, and thus has a flat configuration. As a result, the dispenser also has a flat configuration which advantageously does not exceed 2 mm. Conversely, as soon as the removable closure member is removed, the return spring can relax because air can then penetrate into the reservoir through the dispensing orifice. The reservoir then contains a small quantity of fluid and a larger quantity of air. By pressing on the sheets making up the reservoir, it is possible to put the contents of the reservoir under pressure, and the fluid and air mixture is then delivered through the dispensing orifice so as to generate a sprayed two-phase jet.

BRIEF SUMMARY OF THE INVENTION

An object of the present invention is to improve such a prior art dispenser in terms of manufacture and also in terms of conservation of the fluid inside the reservoir.

To achieve these objects, the present invention makes provision for the resilient means to be situated outside the reservoir, not in contact with the fluid. By disposing the resilient means outside the reservoir, it is possible to avoid having to perform an installation operation consisting in placing the resilient means, e.g. in the form of a spring, between the two component sheets of the reservoir. Thus, the reservoir can be filled with fluid and sealed while the resilient means are not yet in place on the dispenser. The resilient means can be mounted on the dispenser after the reservoir has been filled with fluid. In addition, because the resilient means are not in contact with the fluid, there is no risk of the fluid being degraded by contamination from the resilient means, which are generally made of metal.

Advantageously, the resilient means are connected to said at least one actuating wall by fixing means. The fixing means may comprise an adhesive. In a variant or in addition, the fixing means may comprise a holding clamp secured to or integral with the actuating wall and in which the resilient means are retained. In a first embodiment, said clamp is fixed to the actuating wall. In a variant, said clamp is made integrally with the actuating wall. In which case, said clamp may be formed by a flap formed by folding a flexible sheet over onto itself, said flexible sheet forming said actuating wall.

In all cases, by using an adhesive and/or one or more holding clamps, the resilient means can be put in place once the reservoir is already filled with fluid and sealed. The operations required to assemble the fluid dispenser are thus simplified.

In a practical embodiment, the resilient means are in the form of a clip having two branches connected together and extending in mutually-diverging manner in the rest position. Advantageously, each of the branches of the clip defines a free end, at least one of the free ends of the branches being secured to the actuating wall. Advantageously, the branches of the clip are connected together at an end of the dispenser that is opposite from the dispensing orifice.

In a preferred embodiment, the dispenser further comprises a removable closure member for closing off the dispensing orifice, the reservoir prior to removal of the removable closure member containing only a small quantity of fluid and little or no air, so that the volume of the reservoir is restricted and the resilient means are compressed, and the reservoir after removal of the closure member containing a small quantity of fluid and a larger quantity of air so that the volume of the reservoir is at its maximum and the resilient means are relaxed to the maximum extent. This type of dispenser is as defined in Document FR 2 791 645.

In another feature of the invention, the dispenser is made up of two flexible sheets connected together and forming the reservoir between them, each flexible sheet forming a respective actuating wall.

In a variant, the fixing means comprise a fixing sheet covering the resilient means and at least a portion of the reservoir.

BRIEF DESCRIPTION OF THE DRAWINGS

The invention is described more fully below with reference to the accompanying drawings which give three embodiments of the invention by way of example.

In the figures.

DETAILED DESCRIPTION

Figures 1A, 1B, 1C:
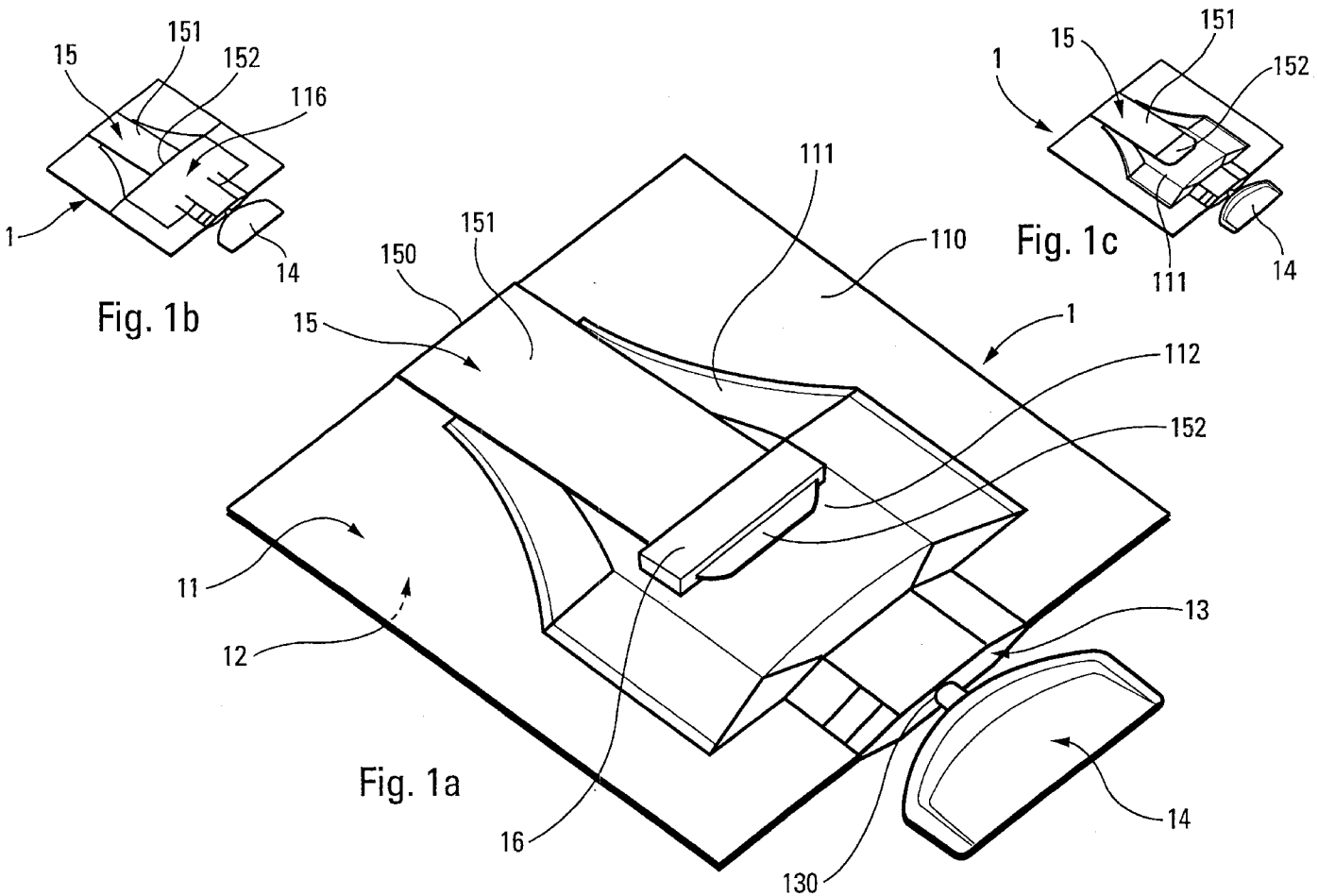
FIGS. 1*a* to 1*c* are diagrammatic perspective top views of three different embodiments of a dispenser of the invention.

In all three of the embodiments described below, the dispenser, designated overall by the numerical reference 1, comprises a reservoir 111 defining at least one actuating wall 112. The dispenser 1 further comprises a dispensing orifice 130 which connects the reservoir 111 to the outside. The reservoir 111 contains fluid (liquid or powder), so that, by pressing on the actuating wall 112, it is possible to cause said fluid to be delivered under pressure through the dispensing orifice 130. Resilient means in the form of a return spring 15 urge the reservoir 111 towards its rest position, corresponding to its maximum working volume.

In the invention, the return spring 15 is situated outside the reservoir 111 so that it is not in contact with the fluid contained in the reservoir.

In all three of the embodiments of FIGS. 1*a* to 1*c*, the dispenser 1 is made up of two flexible sheets 11 and 12 that are connected together around their peripheries 110. The two sheets 11 and 12 thus together define an internal volume which corresponds to the reservoir 111. The dispenser 1 further comprises a piece 13 which is held between the two sheets 11 and 12 and which closes off the reservoir 111. The piece 13 defines the dispensing orifice 130. The dispenser further comprises a removable closure member in the form of a tear-off tab 14 which closes off the dispensing orifice 130 prior to use.

The piece 13 may also act as a support for a block of porous material 131 able to be impregnated with fluid product.

Since the dispenser is made up of two flexible sheets 11 and 12, it defines two deformable actuating walls 112, one on each of its faces.

It is also possible to consider a dispenser made up of a single flexible sheet connected to a substantially rigid or rigid substrate. In which case, the dispenser defines a single actuating wall only. The rigid or substantially rigid substrate may optionally be shaped or thermoformed to define the working volume of the reservoir 111. The present invention is not limited to the particular type of material used to form the reservoir and the dispensing orifice.

Figure 2A:
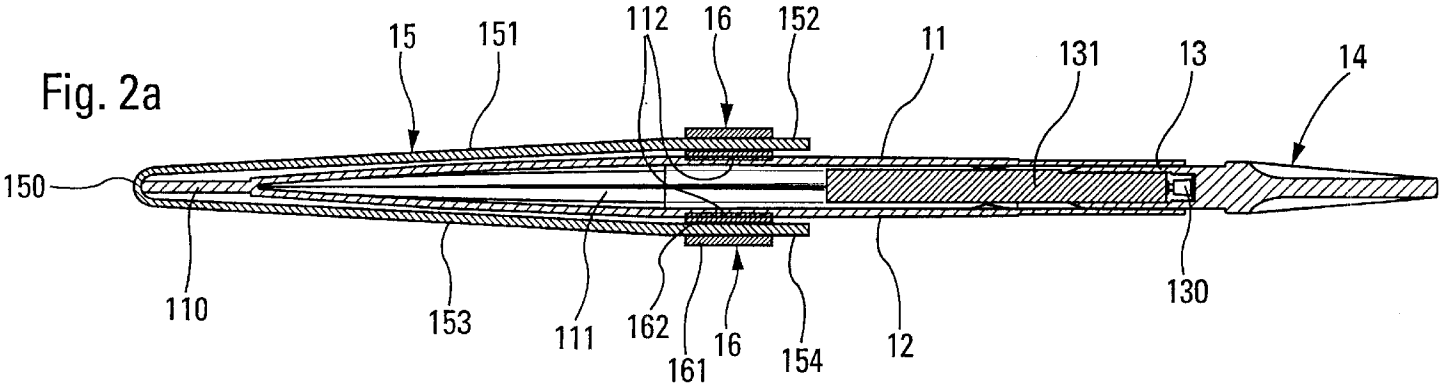
FIGS. 2*a* to 2*c* are vertical section views through the three dispensers of FIGS. 1*a* to 1*c*, respectively.
Figure 2B:
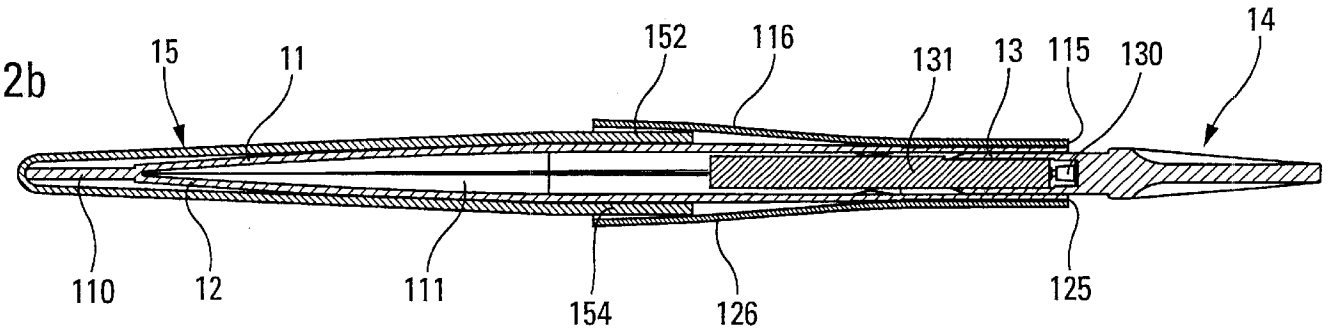
Figure 2C:
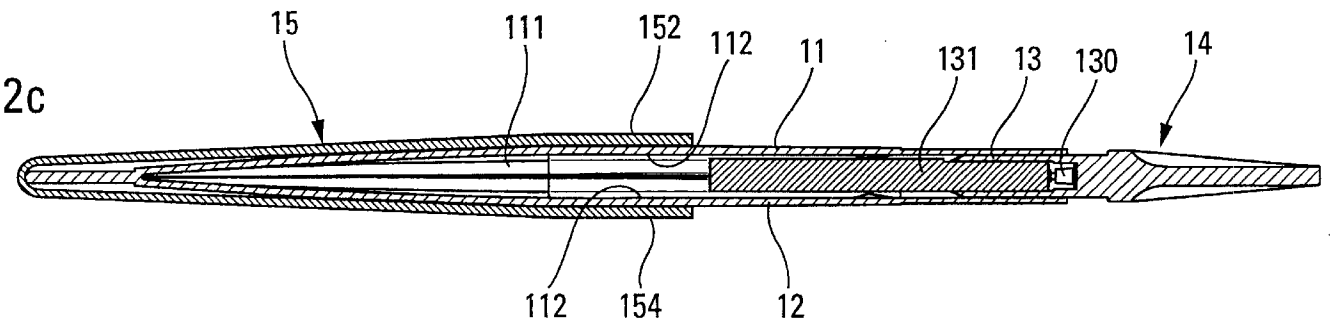

FIGS. 2*a* to 2*c* show that, when the removable closure member 14 is in place, the reservoir 111 defines only a small or even minimum working volume. In reality, the reservoir 111 contains only a small quantity of fluid and little or no air. This is a preferred advantageous characteristic of the invention, but it is not essential and it is possible to omit it.

The return spring 15 extends outside the reservoir 111 over both of the sheets 11 and 12. In this example, the spring 15 is implemented in the form of a clip having two branches 151 and 153 connected together via a link portion 150. The two branches 151 and 153 extend in mutually diverging manner in the rest position. The two branches 151 and 153 may, for example form an angle in the range 15° to 30°. The two branches can be brought into contact with each other in resilient manner.

In the invention, each branch 151, 153 is fixed to an actuating wall 112. More precisely, the branches 151 and 153 have respective end portions 152 and 154 that are fixed to the actuating walls 112 by suitable fixing means. The spring 15 is disposed on the reservoir 111 with its link portion 150 situated at the end further from the removable closure member 14. However, it is possible to consider angularly positioning the spring 15 differently on the reservoir 111. It is necessary merely for the resilient branches of the spring 15 to be able to act on the actuating walls 112.

Since the branches 151 and 153 form a mutually-diverging angle between them, the actuating walls 112 are urged apart so as to increase the working volume of the reservoir 111. However, this is possible only after the removable closure member 14 has been removed, thereby allowing air to enter the reservoir. When the removable closure member 14 is in place, the reservoir is at its minimum volume, thereby preventing the actuating walls 112 from moving apart. FIGS. 2*a* to 2*c* show the dispenser prior to use, i.e. with the removable closure member 14 in place. The spring 15 is then loaded, i.e. compressed so as to bring the branches together. The spring 15 is held in this loaded state so long as the removable closure member 14 closes off the dispensing orifice 130. Conversely, as soon as the removable closure member is removed, air can penetrate into the reservoir 111, and the spring 15 relaxes, and entrains the actuating walls 112 with it. The working volume of the reservoir then increases suddenly so that it contains both fluid and air.

It is easy to understand that the reservoir 111 may be filled and sealed first, and that the spring 15 can be mounted on the reservoir subsequently. The spring 15 is thus not in contact with the fluid. In addition, it is much simpler to install it because it then does not interact with the operation of filling and sealing the reservoir.

The three embodiments shown in the figures differ from one another only by the fixing means used to fix the branches of the spring 15 to the actuating walls 112.

In the first embodiment shown in FIGS. 1*a* and 2*a*, the outsides of the actuating walls 112 are provided with holding clamps 16, each of which forms a sort of keeper through which the respective end 152, 154 of the respective branch 151, 153 is engaged and held. Each clamp 16 comprises a fixing strip 162 fixed to the respective actuating wall 112, e.g. by means of an adhesive. The clamp 16 further comprises a retaining strip 16 which extends above the fixing strip 162. To put the spring in place, it is necessary merely to load it and then to engage the ends of the branches through the clamps 16. Even when the compression exerted on the branches of the spring is released, they do not relax because they are retained by the clamps 126 fixed to the actuating walls 112 which are held almost touching because of the presence of the removable closure member. Thus, in this embodiment, retaining clamps are used that are fixed to the actuating walls by adhesion.

In the embodiment shown in FIGS. 1*b* and 2*b*, retaining clamps 116, 126 are also provided on both faces of the reservoir at the actuating walls 112. However, these clamps 116, 126 are made integrally with the respective sheets 11 and 12. More precisely, the sheets 11, 12 are folded over on themselves to form two folds 115 and 125. The fold-over portions form the clamps 116 and 126 under which the ends 152 and 154 of the branches of the spring 15 are engaged and held. This embodiment is advantageous because it does not use any adhesive to implement the retaining clamps, which can be heat-sealed.

The third embodiment shown in FIGS. 1*c* and 2*c* makes provision merely to bond the ends 152 and 154 of the branches of the spring 15 to the actuating walls 112 by means of a suitable adhesive.

Figure 3B:
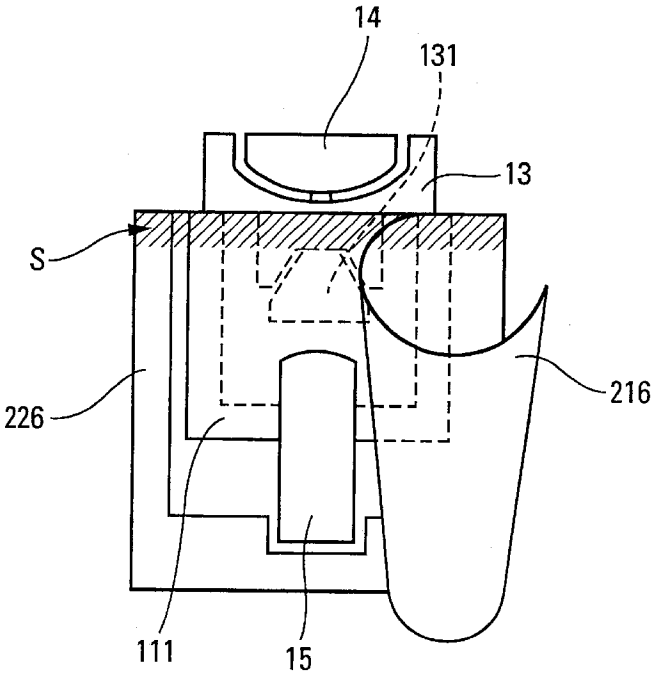
FIGS. 3*a* and 3*b* are views of a fourth embodiment of the present invention.
Figure 3A:
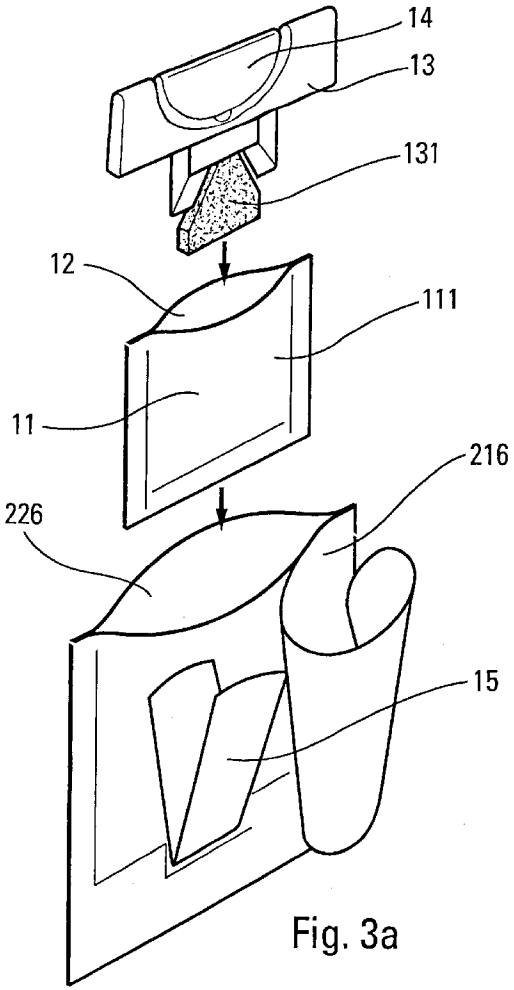

In a variant, the folded-over portions may cover the spring entirely so that it is no longer visible. For this purpose, it is necessary merely for the folded-over portions to be long enough to extend over the whole reservoir, and even to overlap at their free ends. The dispenser is then entirely encased in the folded-over portions which cover the spring so that it is clamped between the component sheets of the reservoir and the folded-over portions of the same sheets. It is also possible to consider having the folded-over portions not formed integrally with the flexible sheets making up the reservoir, but rather formed by separate sheets mounted on the reservoir with the spring interposed, as may be seen on FIGS. 3*a* and 3*b*. In this embodiment, the reservoir 111 is inserted in an outer envelop containing a spring 15. This envelop is here formed by two sheets 216 and 226 secured, advantageously by heat sealing, on the sheets 11 and 12 in a sealed manner at the hatched zone S on FIG. 3*b*, so that here is almost no air between the envelop and the reservoir. Hence, the actuating wall is stuck to the spring.

By disposing the spring outside the reservoir, the dispenser is made easier to manufacture, and the conservation of the fluid to be dispensed is improved.

What is claimed is:

1. A fluid dispenser comprising a fluid and air reservoir (111) of variable volume, and a dispensing orifice (130), said reservoir being provided with at least one deformable actuating wall (112) urged by resilient means (15) into a rest position corresponding to the reservoir having its maximum volume containing both fluid and air, said dispenser being characterized in that the resilient means (15) are situated outside the reservoir (111), not in contact with the fluid.

2. A dispenser according to claim 1, in which the resilient means (15) are connected to said at least one actuating wall (112) by fixing means (16; 116, 126).

3. A dispenser according to claim 2, in which the fixing means comprise an adhesive.

4. A dispenser according to claim 2, in which the fixing means comprise a holding clamp (16; 116, 126) secured to or integral with the actuating wall (112) and in which the resilient means are retained.

5. A dispenser according to claim 4, in which said clamp (16) is fixed to the actuating wall (112).

6. A dispenser according to claim 4, in which said clamp (116, 126) is made integrally with the actuating wall (112).

7. A dispenser according to claim 6, in which said clamp (116, 126) is formed by a flap formed by folding a flexible sheet over onto itself, said flexible sheet forming said actuating wall (112).

8. A dispenser according to claim 2, in which the fixing means comprise a fixing sheet covering the resilient means and at least a portion of the reservoir.

9. A dispenser according to claim 1, in which the resilient means (15) are in the form of a clip having two branches (151, 153) connected together and extending in mutually-diverging manner in the rest position.

10. A dispenser according to claim 9, in which each of the branches (151, 153) of the clip defines a free end (152, 154), at least one of the free ends of the branches being secured to the actuating wall (112).

11. A dispenser according to claim 9, in which the branches of the clip are connected together at an end of the dispenser that is opposite from the dispensing orifice.

12. A dispenser according to claim 1, further comprising a removable closure member (14) for closing off the dispensing orifice (130), the reservoir prior to removal of the removable closure member containing only a small quantity of fluid and little or no air, so that the volume of the reservoir is restricted and the resilient means are compressed, and the reservoir after removal of the closure member containing a small quantity of fluid and a larger quantity of air so that the volume of the reservoir is at its maximum and the resilient means are relaxed to the maximum extent.

13. A dispenser according to claim 1, made up of two flexible sheets (11, 12) connected together and forming the reservoir (111) between them, each flexible sheet forming a respective actuating wall (112).

14. A dispenser according to claim 1, in which the reservoir (111) is located in an envelop (216, 226) containing said resilient means.

15. A dispenser according to claim 14, in which said envelop is secured in a sealed manner to the reservoir.

16. A fluid dispenser comprising:

a reservoir of variable volume, including a first volume and a second volume that is greater than the first volume, the reservoir comprising at least one deformable actuating wall;

a dispensing orifice; and a resilient member;

wherein the resilient member, when in a relaxed state, urges the at least one deformable actuating wall to a position corresponding to the reservoir having the second volume and in which the reservoir contains fluid and air; and wherein the resilient member is disposed outside the reservoir so as not to contact the fluid.

17. The dispenser according to claim 16, wherein the resilient member is connected to the at least one actuating wall by an adhesive.

18. The dispenser according to claim 16, wherein the resilient member is connected to the at least one actuating wall by a holding clamp secured to or integral with the at least one actuating wall and in which the resilient member is retained.

19. The dispenser according to claim 18, wherein the clamp is formed by a flap formed by folding a flexible sheet over onto itself, the flexible sheet forming at least part of the actuating wall.

20. The dispenser according to claim 16, wherein the resilient member is a clip having two branches connected together and extending in mutually-diverging manner in the rest position.

21. The dispenser according to claim 20, wherein each of the branches of the clip defines a free end, at least one of the free ends of the branches being secured to the actuating wall.

22. The dispenser according to claim 16, wherein the resilient member is connected to the at least one actuating wall by a fixing sheet covering the resilient member and at least a portion of the reservoir.

23. The dispenser according to claim 16, wherein the reservoir is located in an envelop containing the resilient member.

24. The dispenser according to claim 23, wherein the envelop is secured in a sealed manner to the reservoir.

* * * * *